US007017376B2

(12) United States Patent
Meckley et al.

(10) Patent No.: US 7,017,376 B2
(45) Date of Patent: Mar. 28, 2006

(54) SEAMLESS TORSO CONTROLLING GARMENT WITH A CONTROL AREA AND METHOD OF MAKING SAME

(75) Inventors: Virginia Meckley, Winston-Salem, NC (US); Kyle C. Pope, Hildebran, NC (US)

(73) Assignee: Sara Lee Corporation, Winston-Salem, NC (US)

( * ) Notice: Subject to any disclaimer, the term of this patent is extended or adjusted under 35 U.S.C. 154(b) by 588 days.

(21) Appl. No.: 10/121,965

(22) Filed: Apr. 12, 2002

(65) Prior Publication Data

US 2003/0192351 A1 Oct. 16, 2003

(51) Int. Cl.
*D04B 1/24* (2006.01)

(52) U.S. Cl. ..... 66/171

(58) Field of Classification Search ..... 66/177, 66/171, 176, 175; 2/401–406; 450/99
See application file for complete search history.

(56) References Cited

U.S. PATENT DOCUMENTS

| | | | | |
|---|---|---|---|---|
| 2,563,308 | A | 8/1951 | Chase et al. | 2/37 |
| 2,687,525 | A | 8/1954 | Rutledge | 2/34 |
| 2,717,388 | A | 9/1955 | Rutledge | 2/41 |
| 2,736,036 | A | 2/1956 | Sinigagliesi | 2/224 |
| 2,928,397 | A | 3/1960 | Pucci | 128/523 |
| 2,971,515 | A | 2/1961 | Geissmann | 128/542 |
| 3,141,318 | A | 7/1964 | Griffith | 66/177 |
| 3,221,749 | A | 12/1965 | Marino | 128/528 |
| 3,339,554 | A | 9/1967 | Nobbs | 128/528 |
| 3,413,824 | A | 12/1968 | Kuney | 66/177 |
| 3,802,229 | A | 4/1974 | Fregeolle | 66/177 |
| 3,824,812 | A | 7/1974 | Matthews et al. | 66/177 |
| 3,906,754 | A | 9/1975 | Sackman | 66/177 |
| 3,946,579 | A | 3/1976 | Heinig | 66/177 |
| 4,390,999 | A | 7/1983 | Lawson et al. | 2/409 |
| 5,280,652 | A | 1/1994 | Davis et al. | 2/409 |
| 5,465,594 | A | 11/1995 | Imboden et al. | 66/177 |
| 5,479,791 | A | 1/1996 | Osborne | 66/171 |
| 5,519,894 | A | 5/1996 | Imboden et al. | 2/409 |
| 5,553,468 | A | 9/1996 | Osborne | 66/171 |
| 5,572,888 | A | 11/1996 | Browder, Jr. et al. | 66/171 |
| 5,590,548 | A | 1/1997 | Osborne | 66/177 |
| 5,592,836 | A | 1/1997 | Schuster et al. | 66/176 |
| 5,605,060 | A | 2/1997 | Osborne | 66/171 |
| 5,611,722 | A | 3/1997 | Osborne | 450/99 |
| 5,762,535 | A | 6/1998 | Nishiyama et al. | 450/98 |
| 5,787,512 | A | 8/1998 | Knox | 2/409 |
| 5,787,732 | A | 8/1998 | Perron et al. | 66/177 |
| 5,814,003 | A | 9/1998 | Knox et al. | 602/63 |

(Continued)

FOREIGN PATENT DOCUMENTS

EP 0508204 A1 10/1992

(Continued)

*Primary Examiner*—Danny Worrell
(74) *Attorney, Agent, or Firm*—Ohlandt, Greeley, Ruggiero & Perle, L.L.P.

(57) ABSTRACT

A circular knit blank for use in the manufacture of undergarments, and the garments so manufactured have a circular knit body, and a reinforcement area or areas. The body has a graded stitch density. The reinforcement area or areas have increased stitch density with resultant shorter stretch and higher modulus formed by shortening the stitch lengths during the knitting process. The garment also has a waist band and leg bands formed using a turned welt. The garment may also have a knitted-in stitch pattern design in the body and reinforcement areas formed using miss positive float combination stitching.

39 Claims, 6 Drawing Sheets

U.S. PATENT DOCUMENTS

| | | | | |
|---|---|---|---|---|
| 5,823,013 | A | 10/1998 | Lonati et al. | 66/177 |
| 5,846,944 | A | 12/1998 | Prasad | 514/25 |
| 5,888,118 | A | 3/1999 | Kishi | 450/122 |
| 5,946,944 | A | 9/1999 | Osborne | 66/176 |
| 5,954,564 | A | 9/1999 | Ganz | 450/99 |
| 5,991,929 | A | 11/1999 | Imboden et al. | 2/409 |
| 6,055,674 | A | 5/2000 | Imboden et al. | 2/409 |
| 6,178,784 | B1 | 1/2001 | Marley, Jr. | 66/173 |
| 6,192,717 | B1 | 2/2001 | Rabinowicz | 66/177 |
| 6,276,175 | B1 | 8/2001 | Browder et al. | 66/171 |
| 6,287,168 | B1 | 9/2001 | Rabinowicz | 450/75 |
| 6,874,337 | B1 * | 4/2005 | Uno et al. | 66/177 |

FOREIGN PATENT DOCUMENTS

| | | | |
|---|---|---|---|
| EP | 0803598 | A1 | 10/1997 |
| JP | 404308201 | A | 10/1992 |
| JP | 408060404 | A | 3/1996 |
| JP | 408144104 | A | 6/1996 |
| JP | 408158109 | A | 6/1996 |
| JP | 408311703 | A | 11/1996 |
| JP | 409003705 | A | 1/1997 |
| JP | 409241902 | A | 9/1997 |
| JP | 409256202 | A | 9/1997 |
| JP | 409296304 | A | 11/1997 |
| JP | 411061503 | A | 3/1999 |
| JP | 41158704 | A | 6/1999 |
| JP | 2000008203 | A | 1/2000 |
| JP | 2001200401 | A | 7/2001 |
| WO | WO98/32347 | | 7/1998 |

* cited by examiner

SEAMLESS TORSO CONTROLLING GARMENT WITH A CONTROL AREA AND METHOD OF MAKING SAME

BACKGROUND OF THE INVENTION

1. Field of the Invention

The present invention relates generally to a control garment and a method for providing additional control in selected portions of a garment. More particularly, the present invention relates to seamless garments provided with one or more reinforcement areas formed by varying stitch density and tightness.

2. Description of the Prior Art

Previously known techniques used for adding support to an undergarment include that disclosed in U.S. Pat. No. 2,736,036 to Sinigagliesi. This patent provides a seamless undergarment knitted as a single piece of tubular knitted fabric, but containing a strengthening patch.

U.S. Pat. No. 3,906,754 to Sackman provides an undergarment having a plurality of integrally knitted panels. Each panel extends circumferentially around the garment. Certain of the courses of each panel are knitted of elastomeric yarn to impart an elastic character to the area.

U.S. Pat. No. 5,572,888 to Browder, Jr. et al., which is owned by the assignee of the present invention, provides a seamless undergarment knit from a first yarn. A control area is formed by knitting in a second, heavier yarn on designated courses along with the first yarn. A predetermined configuration of plain jersey stitch loops and tuck loops are utilized in the control area to achieve the characteristics of a foundation garment.

U.S. Pat. No. 5,590,548 to Osborne provides a circularly knit legged panty having knit-in shaping panels. The panels are formed by modifying the knit structure in selected areas to form regions having a greater resistance, particularly coursewise resistance, to stretch than the remainder of the tubular body. The patent provides that greater resistance to stretch can be accomplished by using conventional knitting structures, such as floating in an elastic yarn or tucking a yarn in selected alternating courses.

However, a need exists for improved seamless undergarments provided with control areas shaped specifically to affect certain areas of the body, such as the hips, waist and stomach. These control areas are formed integrally with the garment so as to appear as an aesthetic, non-bulging feature and, thus, no different than the remainder of the integral garment.

SUMMARY OF THE INVENTION

It is an object of the present invention to provide an improved seamless garment having areas of additional control that are shaped to affect desired areas of the body.

It is another object of the present invention to provide such a garment in which the control areas are reinforced knitted areas having higher stitch density than the remainder of the garment.

It is yet another object of the present invention to provide such a garment that is formed using any combination of jersey, alternating knit and miss, or alternating knit and tuck stitches.

It is still another object of the present invention to provide such a garment in which the areas of higher stitch density have lower stretch and higher modulus and power.

It is a further object of the present invention to provide such a garment in which the reinforced knitted areas are formed using select yarn feed-in tensioning while either changing, or still maintaining, the same basic stitch construction configuration of either plain knit jersey, alternating knit and miss, or alternating knit and tuck stitches.

It is a further object of the present invention to provide such a garment in which the reinforced knitted areas are formed by shortening the stitch length in the specified area or areas during the knitting process.

It is a still further object of the present invention to provide such a garment having a design integrally knitted therein which design is not obscured by the reinforced areas.

It is also an object of the present invention to provide such a garment as a lower torso garment undergarment.

It is another object of the present invention to provide such a garment having a turned welt waistband and leg bands.

It is yet another object of the present invention to provide a method of manufacturing the blank and the garment of the type set forth herein.

In accordance with the present invention, a circular knitting machine knits a single tubular blank including a tubular knit body. The tubular knit body may be formed using any combination of jersey, alternating knit and miss, or alternating knit and tuck stitches. In the area of the garment where increased control is desired, a reinforced area having higher stitch density is knitted. The reinforced area or areas are formed by shortening the stitch lengths during the knitting process.

DETAILED DESCRIPTION OF THE INVENTION

Figure 1:
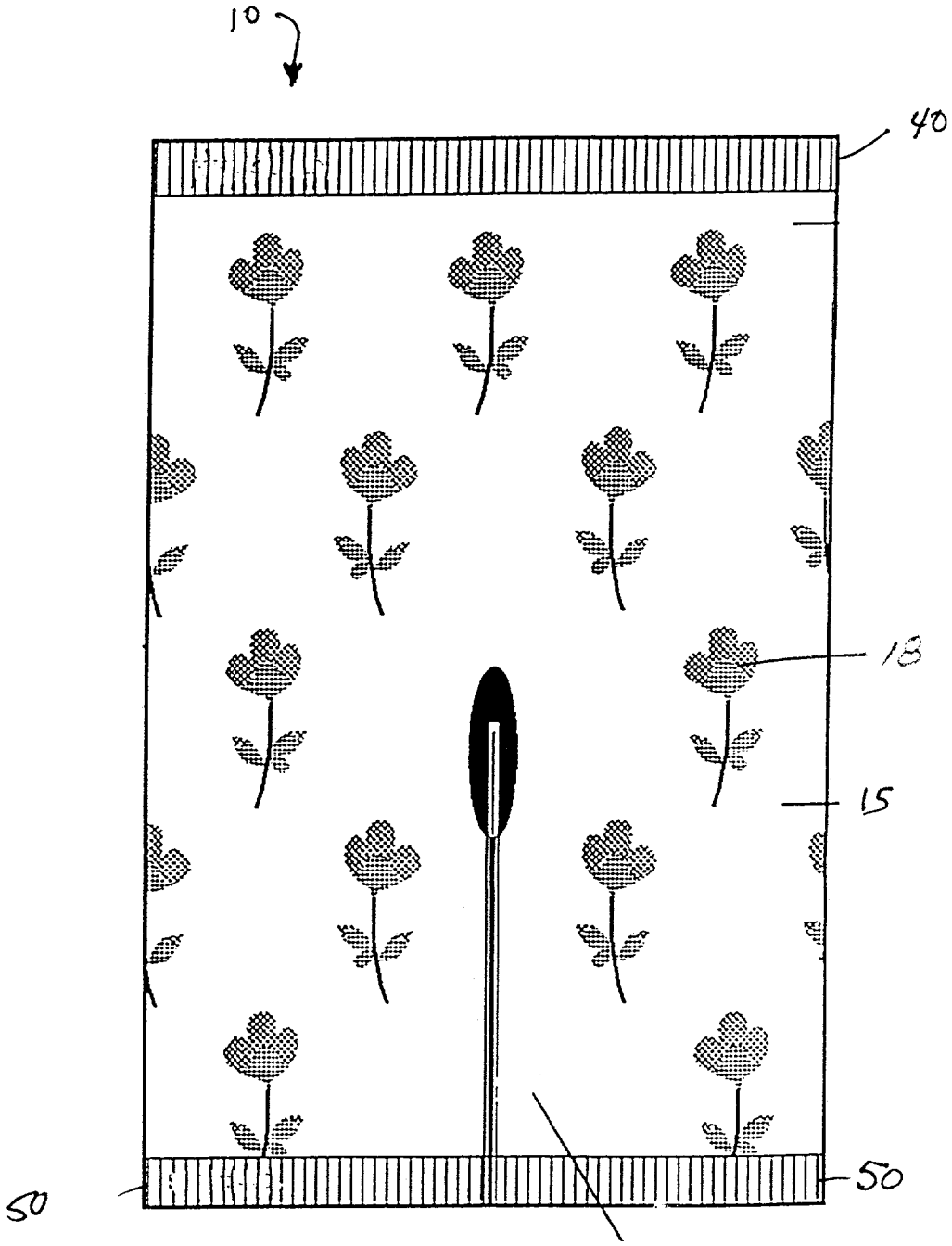
FIG. 1 is a frontal view of a brief of the preferred embodiment of the present invention.
Figure 2:
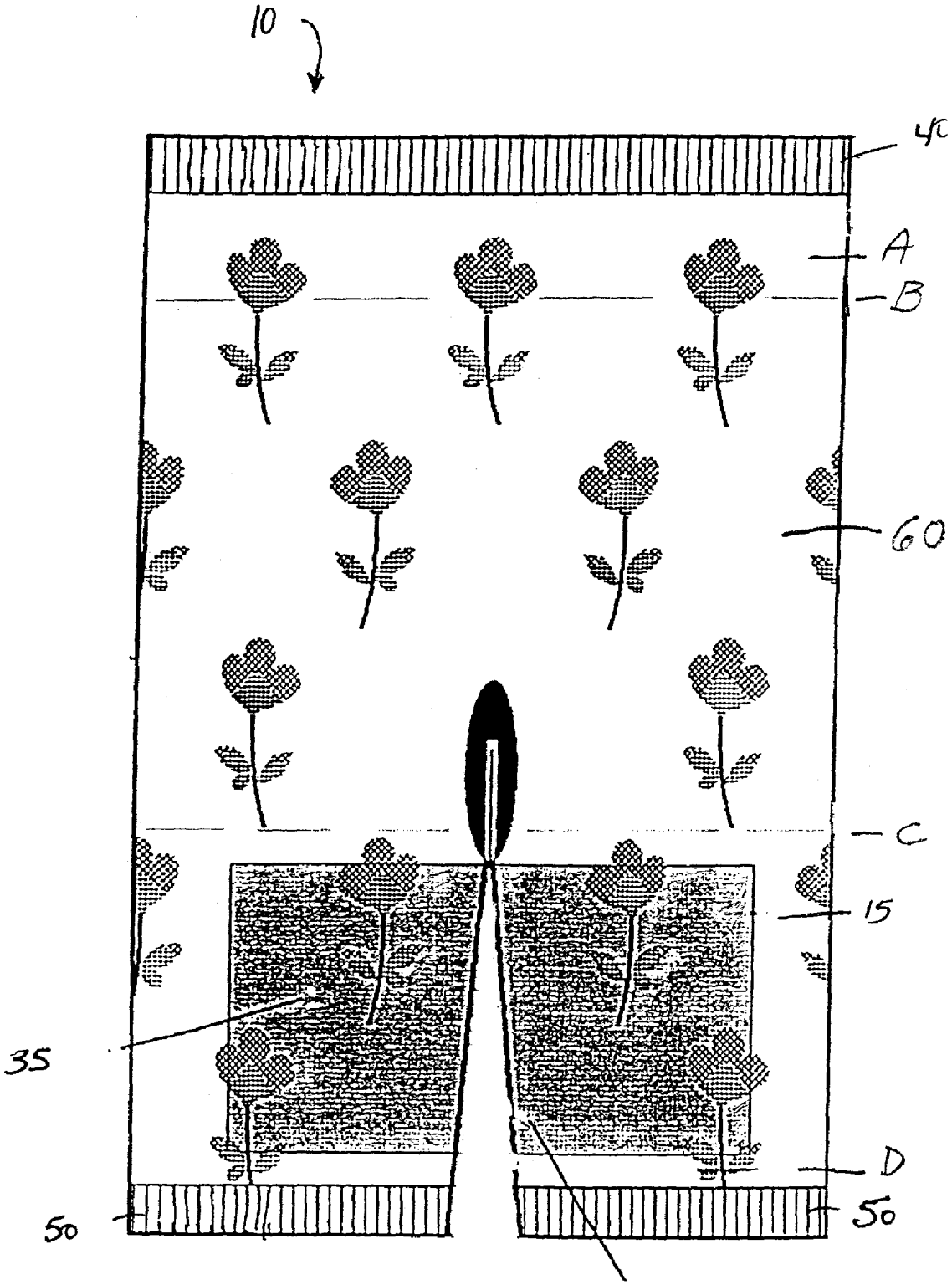
FIG. 2 is a rear view of the brief of the preferred embodiment of the present invention, having a reinforced area in the lower thigh region.

Referring to the drawings and, in particular FIGS. 1 and 2, there is illustrated a brief according to the present invention generally represented by reference numeral 10. Brief 10, as with all the embodiments of the present invention, is formed as a unitary, seamless knit, tubular garment blank or body 15. The body 15 preferably has a waistband 40, and preferably a pair of leg or hem bands 50. Brief 10 also has a reinforced area or areas 35, as shown in FIGS. 2, 3, and 4, for providing better fit and increased support to the garment.

Figure 3:
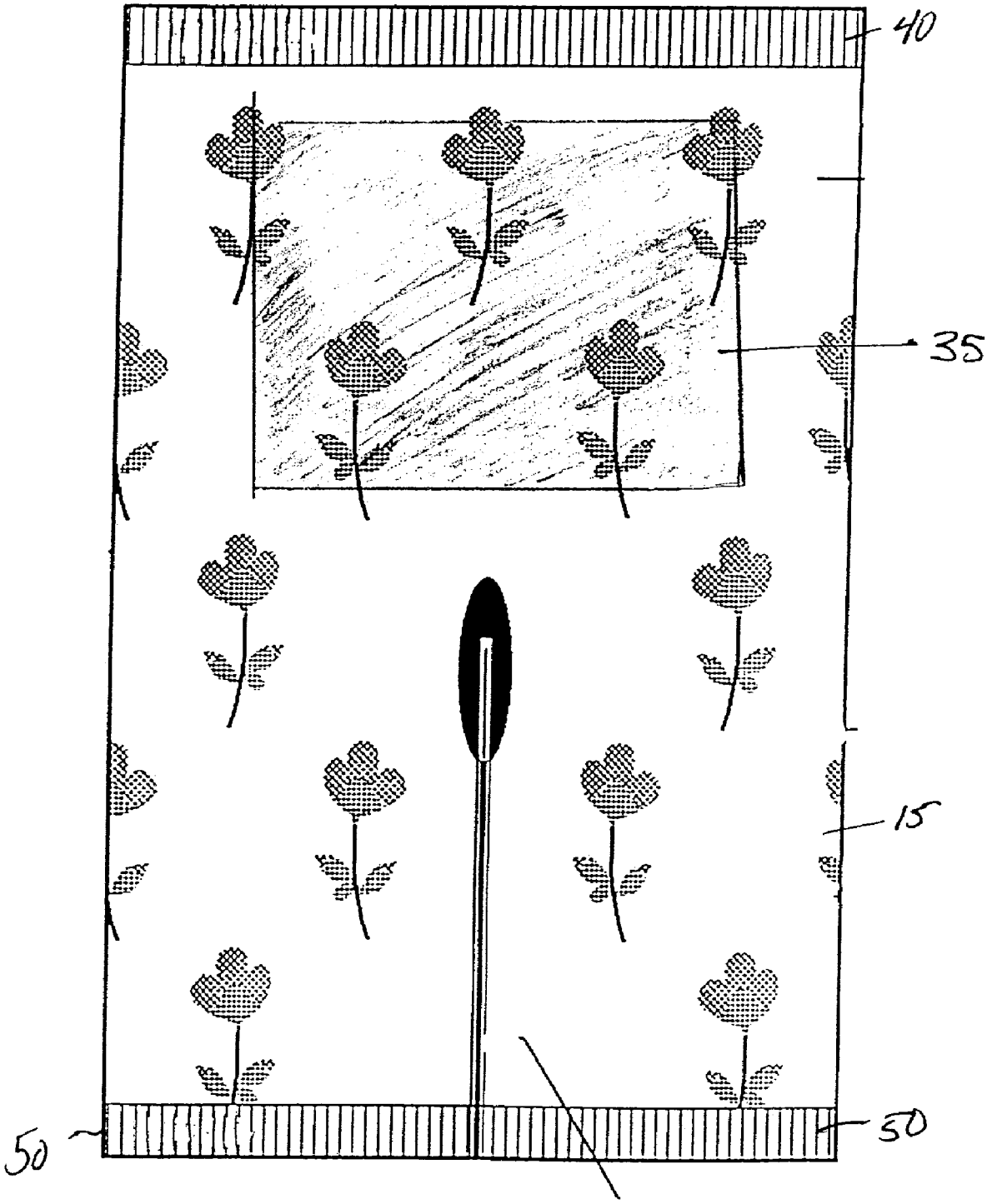
FIG. 3 is a frontal view of an alternate embodiment of the present invention, having a reinforced area in the abdominal region.
Figure 4:
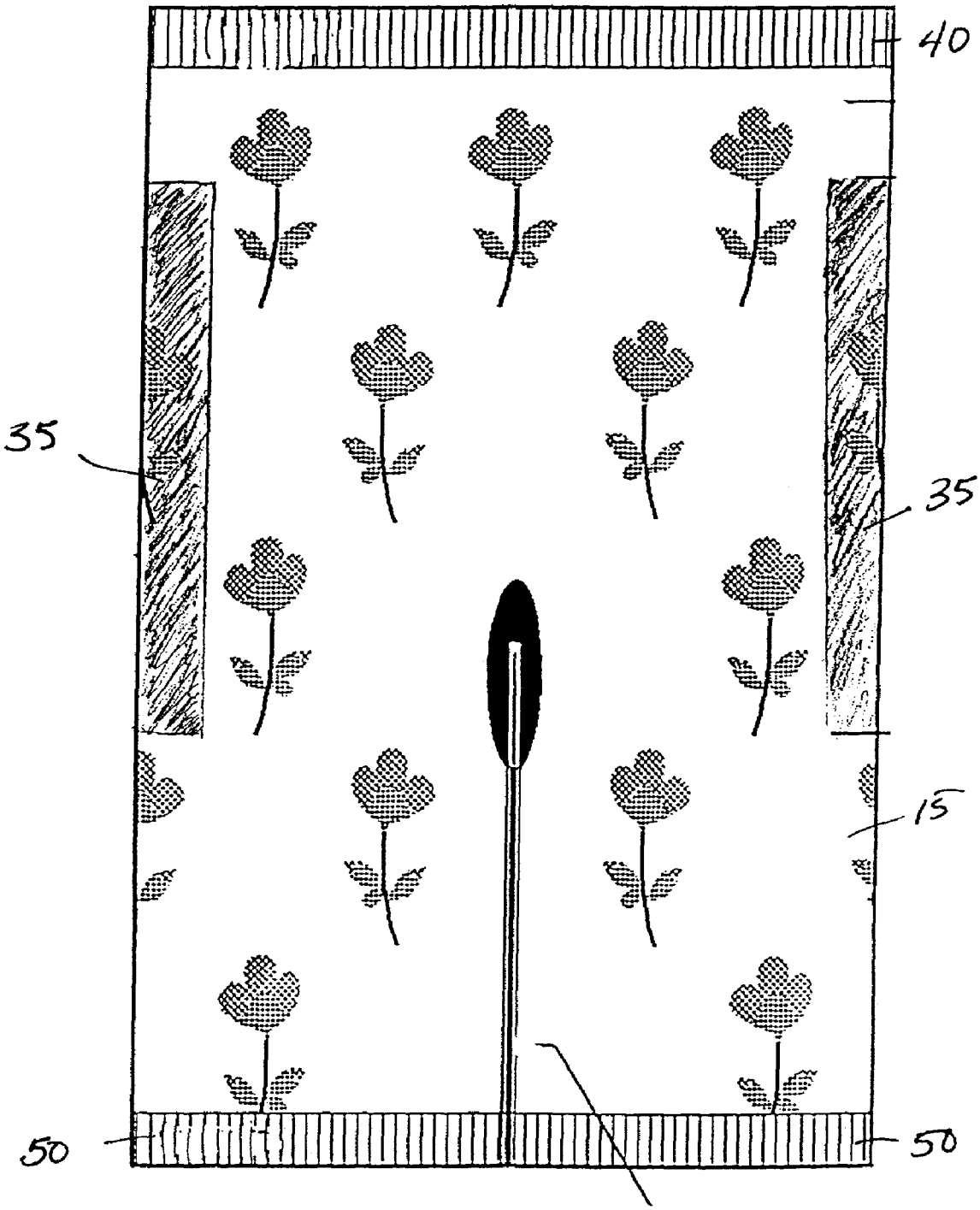
FIG. 4 is a frontal view of another embodiment of the present invention, having reinforced areas in the hip region.
Figure 5:
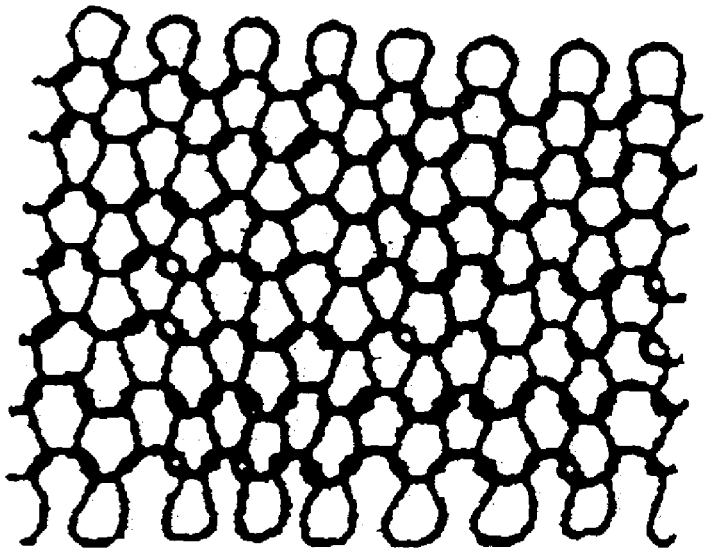
FIG. 5 is the stitch of higher density, having shorter stitch lengths, of the reinforced area or areas of the garment of the present invention.
Figure 6:
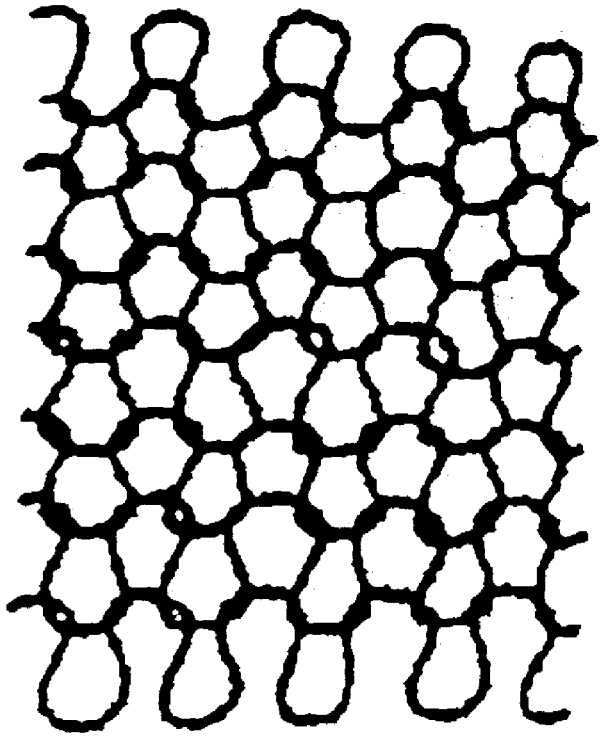
FIG. 6 is the stitch of lower density, having longer stitch lengths, of the higher stretch and lower modulus area or areas of the garment of the present invention.

Reinforcement area or areas 35, as shown in FIGS. 2, 3 and 4, are areas of brief 10 where increased control is desired. Reinforcement area 35 is an overlapping pattern formed using the knitting machine overlapping pattern capability option and shorter stitch lengths. Shorter stitch lengths reduce the amount of yarn available for a stitch, or a series of stitches in a course, thereby reducing the amount of yarn available for stretch in the resultant fabric. Longer stitch lengths increase the amount of yarn available for a stitch, or a series of stitches in a course, thereby increasing the amount of yarn available for stretch in the resultant fabric. The overlapping pattern capability option allows electronic control of the stitch cam stepping motors during the knitting of a select overlapping pattern area without modification of the original underlying base pattern of the actual item.

In the preferred embodiment, reinforced area 35 is placed at the back of the garment. Preferably, reinforced areas 35 are in the area of the leg portions at the bottom thigh covering portion of the garment, under the buttocks of the wearer, as shown in FIG. 2. However, reinforced area or areas 35 may be placed anywhere increased control is desired. Such areas may include the abdominal covering portion of the garment, as shown in FIG. 3, or the hip covering portions of the garment, as shown in FIG. 4.

According to the present invention, a blank is formed on a circular knitting machine preferably having a fully computerized electronic needle and yarn feed selection system, such as, for example, machine Model No.'s SM8-8, SM8-83, manufactured by Santoni® of Brescia, Italy, which have overlapping pattern capability options. Knitting machines for producing a circular knit fabric are widely used in the industry, and their construction and mode of operation are well known. The individual leg portions at the bottom of the seamless tubular knitted blank of brief 10 are cut from the blank using a sewing machine that simultaneously cuts along a slit line and finishes the crotch area while attaching a suitable crotch fabric panel insert that can be made of a like or similar circular knit spandex/nylon construction of brief 10. In a method of making brief 10 or seamless circular knit lower torso shaping garment that has integrally knitted top waist and lower leg comfort bands, select integrally knitted areas with varying degrees of stitch tightness and density are used. These areas have select yarn feed-in tensioning while either changing or still maintaining the same basic stitch construction configuration of either knit, miss, or tuck stitches throughout the lower torso garment.

The undergarment of all embodiments of the present invention, including brief 10, has a body 15 formed of an elastomeric or stretch yarn, such as spandex, and a rigid non-stretch or low stretch yarn, such as textured filament nylon. Such yarns provide softness, comfort, and desired wicking properties.

In the preferred embodiment, the stretch yarn is a spandex covered with a multifilament textured nylon. Preferably, the spandex is in the range of about 20 denier to about 140 denier. More preferably, the spandex is about 70 denier. Preferably, the nylon covering is in the range about of about 20 denier to about 120 denier. More preferably, the nylon covering is about 40 denier. Preferably, the range of filament counts is about 6 filaments to about 200 filaments. More preferably, the filament count is about 34 filaments. While not preferred, a direct knitted bare spandex yarn can be used instead of a covered spandex yarn, and a flat or textured non-stretch nylon yarn coming from a separate yarn feed can be knitted along with the bare spandex, rather than using the covered spandex yarn component.

The rigid non-stretch yarn is a continuous filament flat nylon yarn. Preferably, the continuous filament flat nylon is in the range of about 40 denier to about 150 denier, and more preferably is about 78 denier. Preferably, the continuous filament flat nylon yarn is of a bright luster, and has a filament count in the range of about 8 to about 100, and more preferably is about 48.

In the preferred embodiment, body 15 has a plain jersey construction. However, body 15 may also be formed of any combination of simple knit constructions, such as plain, miss, knit, or tuck. For example, alternating knit-miss stitches or alternating knit-tuck stitches may be used.

In a preferred embodiment, the stretch and rigid non-stretch or low stretch yarns are knit throughout the garment of the present invention at gradually decreasing tension, beginning at an area of highest tension, adjacent waistband 40, and graduating to a sequentially looser stitch formation, adjacent leg bands 50. The density gradation is produced by select yarn feed-in tensioning while maintaining the same basic plain jersey knit, or alternating knit-miss stitches or alternating knit-tuck stitch construction throughout the garment. The stitch lengths are lengthened as the courses are knitted toward the leg bands 50. Preferably, the stitches of the yarns in the area adjacent waistband 40 are about 30 percent to about 35 percent tighter and denser with shorter stitch lengths, higher modulus, and shorter stretch than the base garment zero point setting. Preferably, the stitches of the yarns in the area adjacent leg bands 50 are at the base fabric zero point and are about 30 percent to about 35 percent looser, and less dense, with longer stitch lengths, lower modulus, and higher stretch than the area adjacent to waistband 40.

Reinforcement areas 35 are differential or overlapping pattern zones having increased stitch tightness and density. The overlapping pattern allows the machine to knit in a tight area in the block without hiding or modifying the pattern in the block, such as tulip 18. The tighter stitch areas are formed by shortening the stitch length in desired areas of support during knitting using select yarn feed-in tensioning. The shortened stitch lengths increases the density and modulus of the fabric so that the fabric stretches less and controls more. Preferably, the modulus of the fabric is increased between about 20% and about 30%, and more preferably about 25%. Increasing the modulus by about 25% provides a desirable compromise between control and comfort.

As shown in the FIG. 2 embodiment, overlapping pattern or reinforcement areas 35 are at back slit line of brief 10.

In a preferred embodiment, brief 10 starting from waistband 40, has an area A of courses with a stitch length tightness setting throughout area A of 35% less than the zero point setting, and continuing preferably for about 176 courses ending at a line B. At line B, stitch graduation zone 60 commences at a minus 35% tighter stitch length than the zero point. Stitch graduation zone 60 is about 440 courses and runs downward towards leg bands 50, knitting progressively looser in a smooth graduated fashion down to and ending at line C where the stitch lengths and density reaches the zero base point setting. Reinforcement area 35 is an overlapping pattern. Reinforcement area 35 is preferably about 304 courses. Reinforcement area 35 is preferably 20% to 30% tighter than the zero point base setting Between reinforcement area 35 and the commencement of leg bands 50, there is an area D that has about 35 to about 40 courses in length and continues knitting at the zero base point stitch tightness setting throughout area D.

Waistband 40 and leg bands 50 can be formed from a turned welt or simply a turn fold line. Preferably, waistband 40 is a turned welt. The fabric, which forms the integrally knitted turned welt, is knit on a circular weft knitting machine, having welting capabilities, using cylinder needles and dial bits in a well-known manner. Waistband 40 preferably has one or more heavy spandex yarns added-in during the knitting process. Preferably, the added spandex yarns are added on 25% of the yarn feeds. The added in yarn is preferably in the range of about 100 to about 400 denier, and more preferably is about 210 denier. A high denier spandex is preferred to make certain that brief 10 stays comfortably in place on the wearer's body. Alternatively, though not preferred, waistband 40 and leg bands 50 may be selected from narrow elastic fabrics such as woven, weft knitted, or warp knitted constructions, such as lace, and attached to the brief 10 by normal sewing methods.

Figure 7:
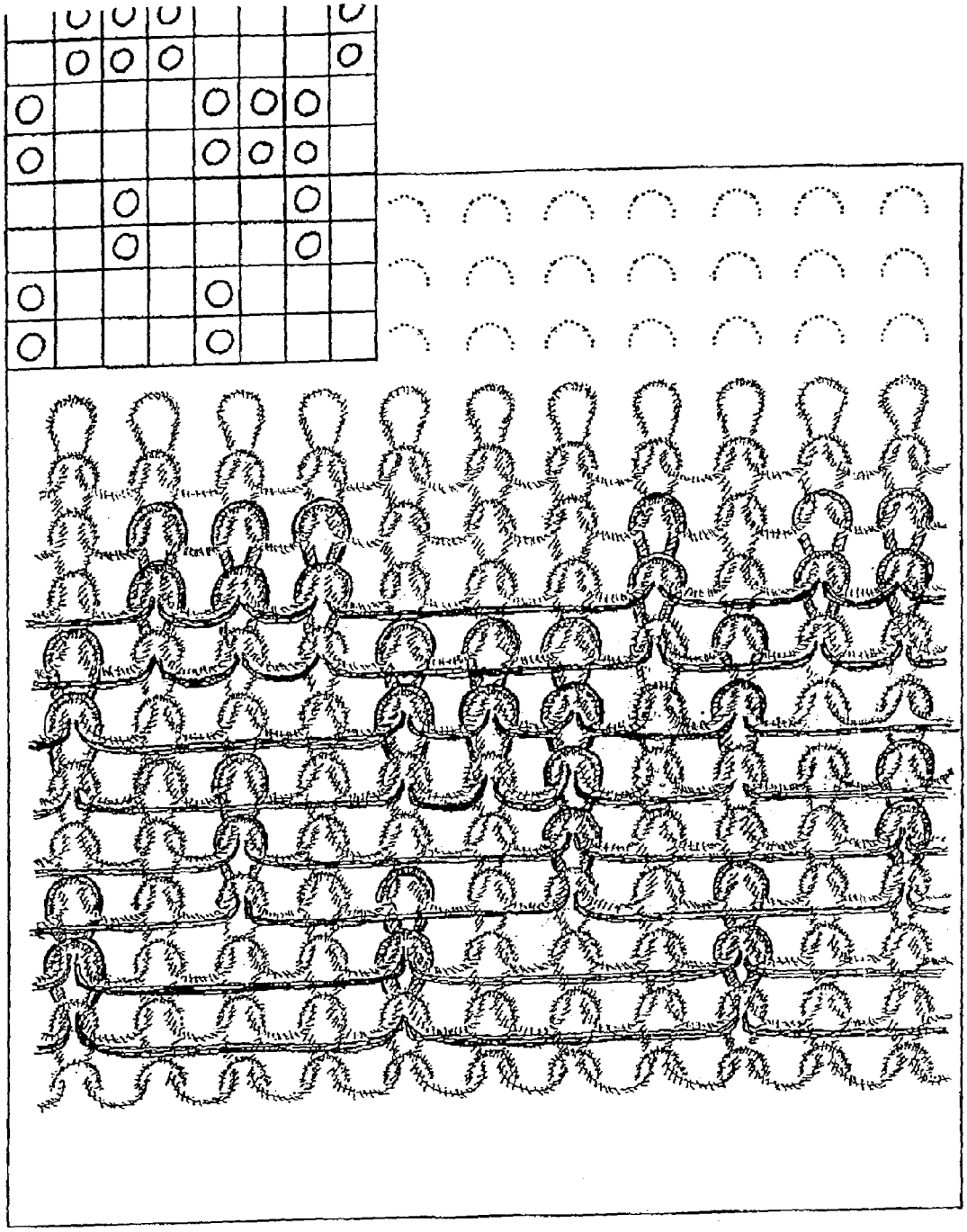
FIG. 7 is a stitch diagram of the preferred embodiment of the present invention.

Brief 10 may have a plain appearance or, optionally, may have a Jacquard, geometric, stylized, abstract, or other design pattern knitted in. Such designs are formed during the knitting process using a bright luster rigid yarn with the spandex yarn. Preferably, the bright luster yarn is a continuous multifilament flat or non-textured nylon yarn that contrasts against the duller luster multifilament textured nylon ground. A miss positive float stitch technique is used to bring the bright luster yarn to the surface of the knitted fabric in the desired pattern. FIG. 7 illustrates the desired stitching technique of the preferred embodiment of the present invention.

The present invention has been described as a lower torso garment, such as a brief. However, it is to be understood that the present invention may be practiced on any garment where support is provided. Examples of such garments include a slip, a bodysuit, a pantliner or a maternity brief.

The present invention having thus been described with particular reference to the preferred forms thereof, it will be obvious that various changes and modifications may be made therein without departing from the spirit and scope of the present invention as defined in the appended claims.

What is claimed is:

1. A circular knit lower torso garment comprising: a body having an aesthetic pattern, said body having a first portion thereof with a graduated stitch density ranging from a short stitch length to a long stitch length, said body having a second overlapping reinforcement area in said first portion with said graduated stitch density, wherein said reinforcement area has an increased stitch density and does not hide or modify the pattern.

2. The circular knit lower torso garment of claim 1, wherein said graduated stitch density of said first portion ranges from an area of lower stretch and increased modulus, to an area of greater stretch and lower modulus.

3. The circular knit lower torso garment of claim 1, wherein said body is formed of any combination of plain, miss, knit or tuck stitches.

4. The circular knit lower torso garment of claim 1, wherein said body is formed of alternating knit-miss stitches.

5. The circular knit lower torso garment of claim 1, wherein said body is formed of alternating knit-tuck stitches.

6. The circular knit lower torso garment of claim 1, wherein said body is formed of a basic plain jersey knit stitch.

7. The circular knit lower torso garment of claim 1, wherein said body is formed of an elastomeric yarn and a rigid non-stretch or low stretch flat or textured yarn.

8. The circular knit lower torso garment of claim 7, wherein said elastomeric yarn is a multifilament textured nylon covered spandex.

9. The circular knit lower torso garment of claim 8, wherein said multifilament textured nylon covered spandex has spandex in the range of about 10 denier to about 140 denier.

10. The circular knit lower torso garment of claim 8, wherein said multifilament textured nylon covered spandex has textured nylon in the range of about 20 denier to about 120 denier.

11. The circular knit lower torso garment of claim 8, wherein said multifilament textured nylon covered spandex has a filament count in the range of about 6 filaments to about 200 filaments.

12. The circular knit lower torso garment of claim 7, wherein said rigid non-stretch or low stretch yarn is a continuous filament flat nylon.

13. The circular knit lower torso garment of claim 12, wherein said continuous filament flat nylon is in the range of about 20 denier to about 150 denier.

14. The circular knit lower torso garment of claim 12, wherein said continuous filament flat nylon filament count is in the range of about 8 filaments to about 100 filaments.

15. The circular knit lower torso garment of claim 1, wherein reinforcement area provides support in specified areas of said garment.

16. The circular knit lower torso garment of claim 1, wherein said reinforcement area is formed using shorter stitch lengths with lower stretch than those of the basic ground body area of the garment in the selected area where applied.

17. The circular knit lower torso garment of claim 1, wherein said reinforcement area has increased modulus and power.

18. The circular knit lower torso garment of claim 1, wherein said reinforcement area is substantially in the thigh covering portion of the garment.

19. The circular knit lower torso garment of claim 1, wherein said reinforcement area is substantially in the abdominal covering portion of the garment.

20. The circular knit lower torso garment of claim 1, wherein said reinforcement area is substantially in the hip covering portion of the garment.

21. The circular knit lower torso garment of claim 1, wherein said garment has a waistband.

22. The circular knit lower torso garment of claim 21, wherein said waistband is a turned welt.

23. The circular knit lower torso garment of claim 21, wherein said waistband has added in elastomeric yarns.

24. The circular knit lower torso garment of claim 23, wherein said elastomeric yarns are in the range of about 100 to about 400 denier.

25. The circular knit lower torso garment of claim 23, wherein said elastomeric yarn is spandex.

26. The circular knit lower torso garment of claim 1, wherein said garment has leg bands.

27. The circular knit lower torso garment of claim 26, wherein said leg bands are turned welts.

28. The circular knit lower torso garment of claim 1, wherein said garment has a knitted-in stitch pattern design.

29. The circular knit lower torso garment of claim 28, wherein said stitch design is formed using a bright luster continuous multifilament flat nylon yarn.

30. The circular knit lower torso garment of claim 28, wherein said stitch pattern design is formed using miss positive float stitches.

31. The circular knit lower torso garment of claim 28, wherein said stitch pattern design continues throughout said body and said reinforcement areas.

32. The circular knit lower torso garment of claim 1, wherein said garment is a slip, a pant liner, a bodysuit or a maternity brief.

33. A circular knit blank for use in the manufacture of undergarments comprising a tubular knit fabric having a body and a reinforcement area, wherein said body has a graded stitch density, stretch and modulus properties, and wherein said reinforcement area has increased stitch density, lower stretch, with higher modulus.

34. A circular knit garment comprising:

a first portion having a first stitch length; and a second portion overlapping said first portion in a selected area, said second portion having a second stitch length, said second stitch length being less than said first stitch length so that said selected area has an increased modulus as compared to said first portion.

35. The circular knit garment of claim 34, wherein said increased modulus is between about twenty and thirty percent higher than said first portion.

36. The circular knit garment of claim 34, further comprising a plurality of second portions overlapping said first portion in a plurality of selected areas.

37. The circular knit garment of claim 34, wherein said first stitch length increases in length from a first area to a second area of the garment.

38. The circular knit garment of claim 34, further comprising a knitted-in stitch pattern design defined in said first portion.

39. The circular knit garment of claim 38, wherein said knitted-in stitch pattern design continues through said selected area.

* * * * *